US005613657A

United States Patent [19]

Olaiz

[11] Patent Number: 5,613,657

[45] Date of Patent: Mar. 25, 1997

[54] BABY BOTTLE KEEPER

[75] Inventor: James Olaiz, Fountain Valley, Calif.

[73] Assignee: Junior Products Inc., Santa Ana, Calif.

[21] Appl. No.: 486,986

[22] Filed: Jun. 7, 1995

[51] Int. Cl.[6] ..... A47D 15/00

[52] U.S. Cl. ..... 248/102

[58] Field of Search ..... 248/102, 318, 248/103, 104, 312, 205.2; 24/3.13

[56] References Cited

U.S. PATENT DOCUMENTS

| | | | |
|---|---|---|---|
| 1,739,910 | 12/1929 | Livergood . | |
| 1,797,456 | 3/1931 | Walker | 24/3.13 |
| 2,084,243 | 6/1937 | Charles | 248/102 |
| 2,518,862 | 8/1950 | Cain et al. | 248/102 |
| 3,065,944 | 11/1962 | Liebendorfer | 248/102 |
| 3,620,491 | 11/1971 | Baclit | 248/104 |
| 4,405,106 | 9/1983 | Adler | 248/104 |
| 4,416,438 | 11/1983 | King . | |
| 4,498,613 | 2/1985 | Donahue et al. . | |
| 4,718,623 | 1/1988 | McClure . | |
| 4,865,239 | 9/1989 | Timbrook . | |
| 4,946,119 | 8/1990 | Hellhake . | |
| 5,058,787 | 10/1991 | Chou | 248/318 |

*Primary Examiner*—Michael Safavi
*Attorney, Agent, or Firm*—Price, Gess & Ubell

[57] ABSTRACT

A retaining mechanism for a baby bottle is provided having a bottle fastening ring at one end and an adjustable, quick release fastening device at the other end of a strap of polypropelene material. The bottle fastening ring is made of an inert strong semi-rigid plastic material and is securely stitched to the strap. The fastening device is a Velcro loop and hook strip. The fastening ring is adapted to slip over the neck of the bottle to rest against the shoulder. The bottle cap with nipple, when fastened to the bottle neck, holds the fastening ring securely in place against the bottle shoulder. The Velcro fastening device is adjustable to fasten around any number of different size structural components on a baby bed, stroller, high chair, or the like.

16 Claims, 2 Drawing Sheets

BABY BOTTLE KEEPER

BACKGROUND OF THE INVENTION

1. Field of the Invention

The present invention relates to baby bottle holders and specifically to means for strapping a baby bottle to a structural support member.

2. Description of Related Art

The prior art approach to strapping a baby bottle to a structural support member, or a care giver, or the infant itself is illustrated in the following patents:

| Patent No. | Title | Inventor | Issue Date |
|---|---|---|---|
| 1,739,910 | Combined Nipple And Bottle Holder | G. R. Livergood | 12/17/29 |
| 4,416,438 | Bottle Holder | King | 11/22/83 |
| 4,498,613 | Support Device For Nursing Bottles And Amusement Items | Donahue et al. | 02/12/85 |
| 4,718,623 | Bottle Sling For Holding A Baby Bottle While Traveling | McClure | 01/12/88 |
| 4,865,239 | Baby Bottle Holder | Timbrook | 09/12/89 |
| 4,946,119 | Security Support For Feeding Bottle | Hellhake | 08/07/90 |

Each of these patents have a different approach to how the strap fastens to the baby bottle and to a structural component. None of the prior art has the advantages of the present baby bottle keeper in that none of the prior art contemplates the manner in which the strap of the present invention attaches to the baby bottle, nor that such attachment mechanism serves a dual function, a means for securely attaching the strap to the baby bottle and a teething ring when not attached to a baby bottle.

OBJECTS AND SUMMARY OF THE INVENTION

It is the main object of this invention to provide a feeding baby bottle support in the form of a strap which eliminates the problems and the inherent dangers of the fastening devices of the prior art while also functioning as a teething ring when not used to support a feeding bottle.

This object and the general purpose of the invention are accomplished by providing a retaining mechanism for a baby bottle having a bottle fastening ring at one end and an adjustable, quick release fastening device at the other end of a strap of polypropelene material. The bottle fastening ring is made of an inert strong semi-rigid plastic material and is securely stitched to the strap. The fastening device is a Velcro loop and hook structure. The fastening ring is adapted to slip over the neck of the bottle to rest against the shoulder. The bottle cap with nipple, when fastened to the bottle neck, holds the fastening ring securely in place against the bottle shoulder. The Velcro fastening device is adjustable to fasten around any number of different size structural components on a baby bed, stroller, high chair, or the like.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention.

Although very young infants are inept at grasping and supporting objects having the size and weight of a typical nursing bottle, once such manipulative abilities are developed the infant is usually able to feed himself without help or constant attention. This self-feeding will normally continue substantially beyond the time that the child is weaned especially with regard to the drinking of water and juices from a bottle. As every mother will attest, a bottle feeding baby with sufficient physical coordination to grasp a bottle has sufficient coordination and strength to throw the bottle out of the crib, playpen, feeding chair, stroller or the like. Retrieving a dropped or thrown bottle, cleaning the bottle and nipple, and restoring the bottle to the child can become a substantial chore for the care giver.

Moreover, a serious health hazard is encountered whenever the thrown bottle contacts septic surfaces outside the home, such as sidewalks and interior walkways in shopping malls, floors in stores, and in day-care facilities, or the like. In such instances the danger of the child's exposure to disease is exasperated by a total absence of means to sterilize a contaminated bottle, especially the nipple. The danger of a child's exposure to disease is exasperated also by an inability to observe and respond to every episode of a dropped or thrown bottle in a typical day, such as in a day-care setting where many infants are fed several times a day. The baby bottle keeper according to the present invention eliminates all these concerns in that it keeps the bottle away from septic surfaces and within reach of the infant that has managed to throw or drop the bottle out of the crib.

Figure 1:
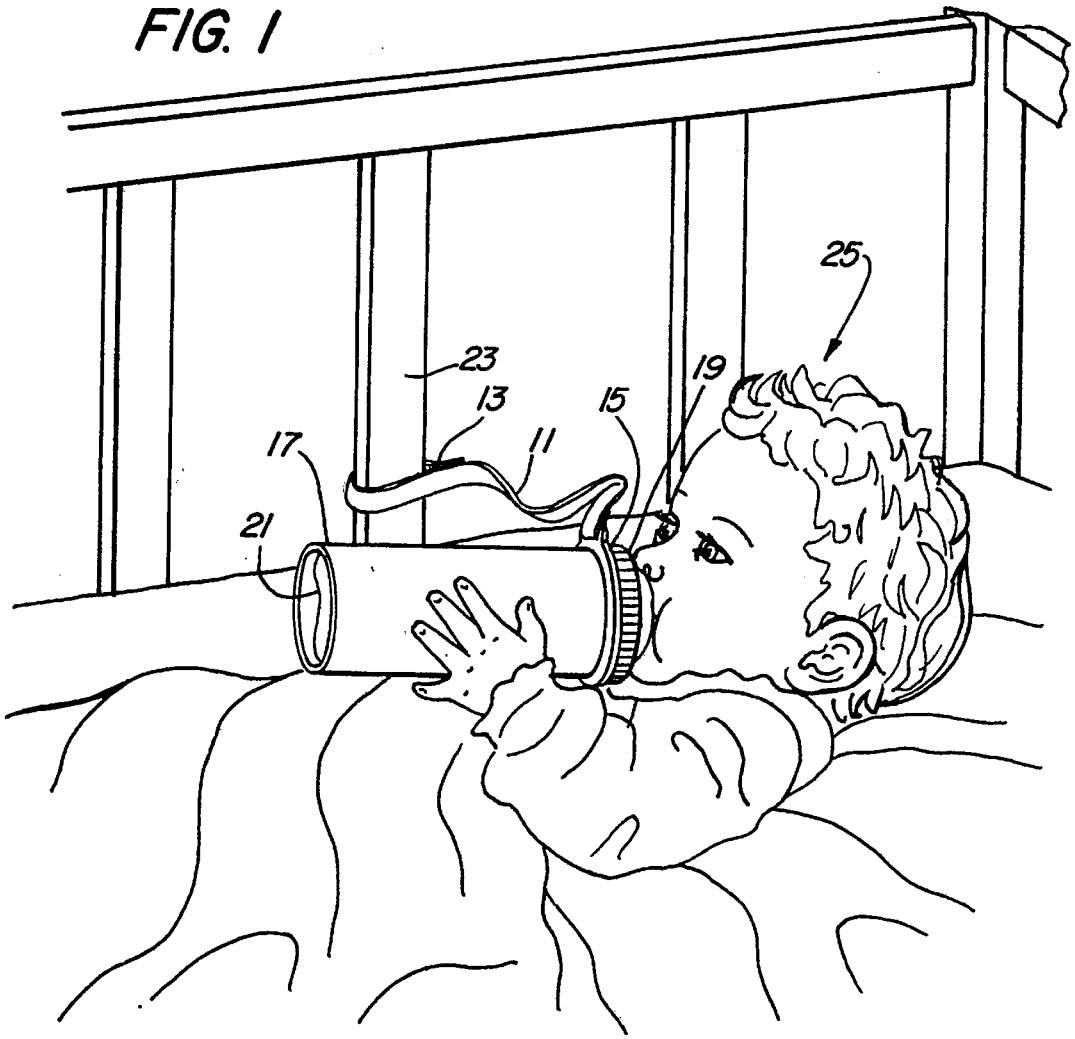
FIG. 1 is a perspective of a baby bottle keeper showing the baby bottle keeper of the present invention in a typical environment.

As shown in FIG. 1 the child 25 is pleasantly drinking from a bottle 17. However, as every mother knows this scene can change instantly when the bottle is thrown or dropped outside the crib. The baby bottle keeper of the present invention utilizes a strap 11 which is looped around and fastened to a crib support component 23. The strap 11 is fastened to itself by means of Velcro hook and loop fasten strips 13. The other end of the strap 11 is fastened to the bottle 17 by a ring 19 which fits over the neck (not shown)

of the bottle 17 and is held to the shoulders of the bottle by the nipple cap 19.

The particular type of bottle 17, illustrated in FIG. 1, utilizes a collapsible plastic bag 21 within a rigid external housing 17 which threadably engages a nipple cap 19. The baby bottle keeper of the present invention is equally adaptable to other types of bottles. It is recommended that bottles made from unbreakable material such as plastic be utilized instead of glass.

Figure 2:
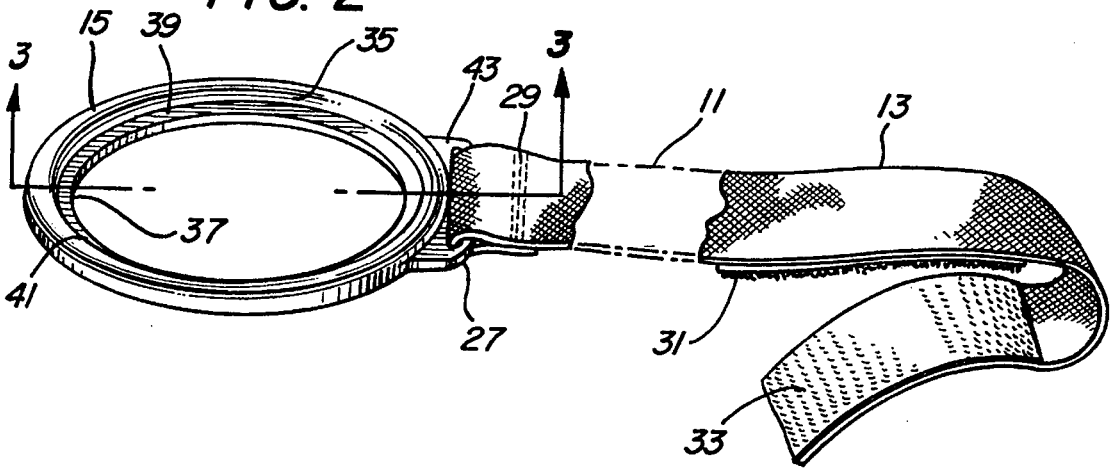
FIG. 2 is a perspective of a first preferred embodiment of the baby bottle keeper of the present invention.

FIG. 2 illustrates in greater detail the construction of the baby bottle keeper shown used to advantage in FIG. 1. The ring 15 has a flat surface 39 on both sides with a circular bore through the symmetrical center of the ring. A berm 41 is located around the circumference of the ring on one side of the ring 15 along the outside diameter. The berm is smooth and rounded. The internal diameter 35 of the berm 41 is larger than the diameter of the bore 37 and sufficiently large to accept the diameter of the nipple cap 19, as shown in phantom in FIG. 3.

A tab 27 is formed as part of the ring 15. The tab has a slot 43 therein wide enough to accept the strap 11 which is looped through the slot 43, around itself, and stitched to itself at a convenient point 29 close to the tab.

The other end 13 of the strap 11 is the end that fastens to a structural component. It has fastened thereto a pair of Velcro fastening strips made up of a loop material 31 and a hook material 33 conveniently placed so as to allow a variety of loop sizes to be formed to accommodate different sizes of structural components.

The baby bottle keeper ring 15 of FIG. 2 is preferably made of a high density polyethylene plastic formed by standard injection molding techniques as a single unit. The strap 11 is preferably made up of polypropelene. Polypropelene is also used for the Velcro loop 31 and hook 33 strips. The thread 29 utilized to fasten the strap to the baby bottle keeper ring is preferably a nylon polyester blend. The entire combination of materials and structure results in a baby bottle keeper that is securely fastened to the bottle 17 and to a structural component 23, thereby providing a fastening means which is immune from disassembly by the infant, yet quickly detachable by the care giver, and more important provides the infant with no means with which to injure itself.

Figure 3:
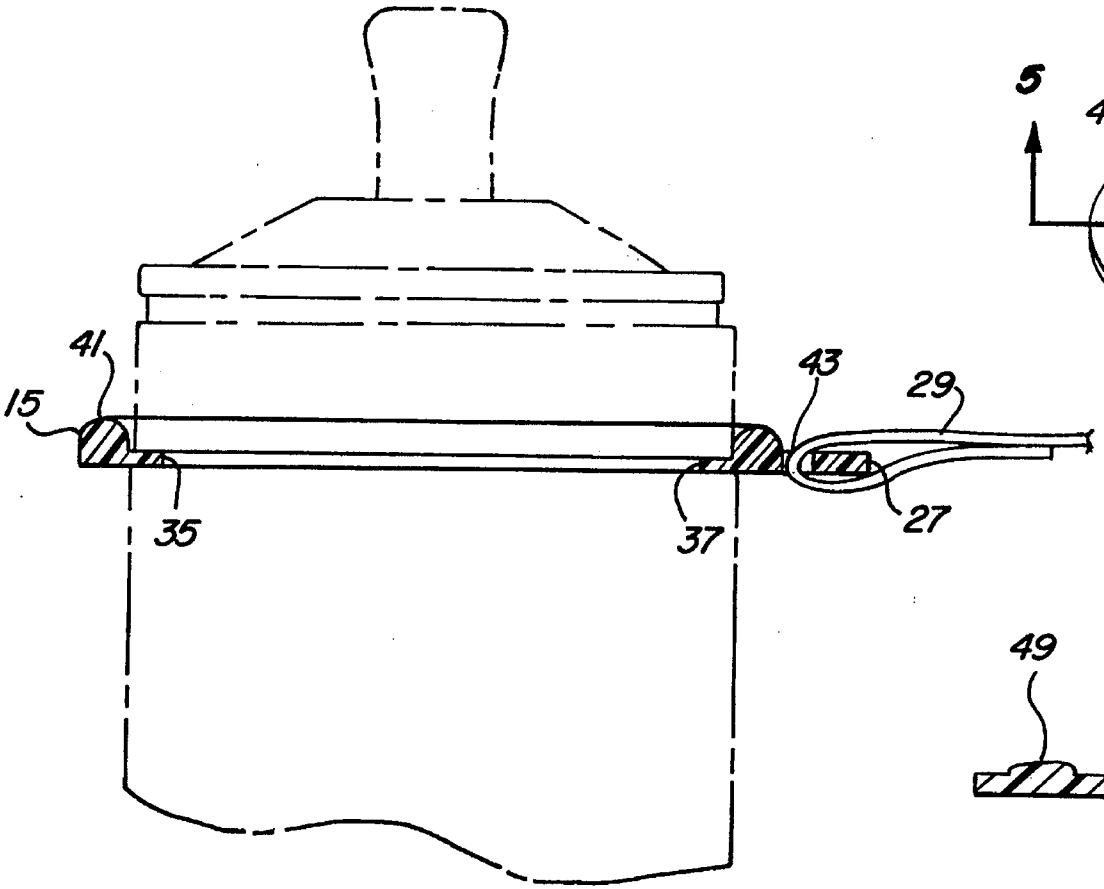
FIG. 3 is a cross section of the baby bottle keeper of FIG. 2 along lines "3—3" showing placement of the baby bottle keeper between a nipple cap and bottle.

FIG. 3 illustrates how the keeper ring 15 is securely fastened to the baby bottle shown in phantom. The bottle keeper ring 15 is slipped over the neck of the bottle and rests upon the shoulders of the bottle, shown in phantom. The diameter of the bore 37 in the ring is large enough to slip over the neck of the bottle. The nipple cap, shown in phantom, threadably engages the neck of the bottle (not shown) and threads down onto the ring within the berm 41. The inside diameter created by the berm is large enough to accept the diameter of the nipple cap. The tab 47 with the slot contained therein, is contained mostly within the loop made by the strap sewn to itself at 29.

Figure 4:
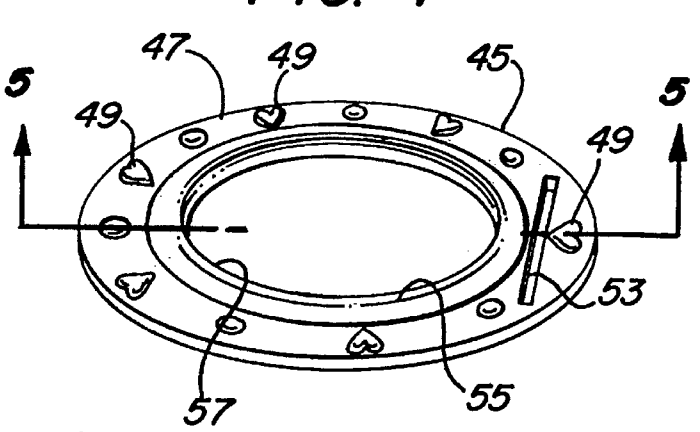
FIG. 4 is a perspective of a second preferred embodiment of a baby bottle keeper without a strap attached.

A preferred alternate baby bottle keeper ring 45 is illustrated in FIG. 4. The ring 45 is made of a plastic material in a flat 47 configuration. The ring in this embodiment has symbols or designs 49 embossed around its circumference. A cylindrical internal bore 57 is symmetrically located in the ring 45. A smooth rounded berm 55 is located on one side of the ring 45 around the perimeter of the bore 57. A slot 53 of sufficient width to accept a strap, like retaining strap 11 of FIG. 2, is located between the berm 55 and the outside circumference of ring 45.

The baby bottle keeper ring of FIG. 4 is preferably made of a low density polyethylene, the entire bottle keeper 45 being injection molded in one piece.

Figure 5:
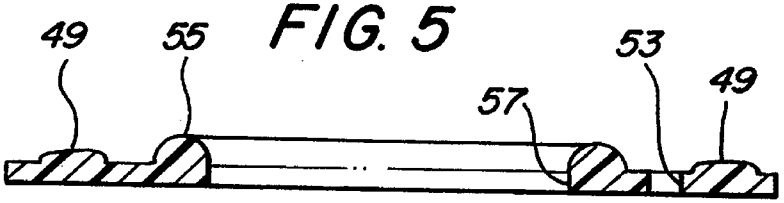
FIG. 5 is a cross section of the baby bottle keeper of FIG. 4 taken along lines "5—5".

As illustrated in FIG. 5 the contours of the berm 55 and the symbols 45 embossed around the perimeter of the ring are smooth and unobtrusive.

In use the ring would slip over the neck of a bottle to rest on the shoulders of the bottle. The nipple cap would then thread down over the neck of the bottle and squeeze the baby bottle keeper ring 45 between the cap and the shoulders of the bottle thereby providing a safe unobtrusive yet strong retaining mechanism.

During those times when the infant is not feeding from a bottle, the baby bottle keeper may be left within an easy reach of the infant by continuing to be fastened to a structural component near the infant without the bottle attached. In those instances the materials used in the baby bottle keeper and the shape of the baby bottle keeper facilitate the use of either ring 45 or 15 as teething rings for the infant. These rings are themselves immune from being thrown onto septic surfaces and becoming contaminated.

The foregoing description of the preferred embodiments of the invention is illustrative and explanatory only, and various changes in size, shape and materials as well as in specific details of the construction may be made without departing from the spirit and scope of the invention.

I claim as my invention:

1. A baby bottle holder for a baby bottle having a cap with a nipple fastened onto the neck of the bottle, said holder comprising:

a plastic ring having an internal bore of a diameter sufficient to slip the ring over the neck of a baby bottle, said ring further having a slot of defined length between the bore and the outside perimeter;

a strap of defined width looped through the slot in said ring and securely fastened to itself at a first end; and a hook and loop fastening strip at the second end of said strap allowing for a variable loop size to fasten the second end of said strap to a structural component.

2. The baby bottle holder of claim 1 wherein said plastic ring is made of a high density polyethylene.

3. The baby bottle holder of claim 1 wherein said plastic ring is flat on one side and has a smooth berm at a distance from and all around the circumference of the bore on the other side, the flat side for resting against the bottle's shoulder with the bottle cap fastening onto the bottle neck against the ring, within the berm.

4. The baby bottle holder of claim 3 wherein said plastic ring is made of high density polyethylene.

5. The baby bottle holder of claim 4 wherein said strap is made of polypropelene.

6. The baby bottle holder of claim 5 wherein the hook and loop fastening strips are made of polypropelene.

7. The baby bottle holder of claim 6 wherein the strap is securely fastened to itself by stitching with a thread having a nylon-polyester blend.

8. The baby bottle holder of claim 1 wherein said plastic ring is made of a low density polyethylene.

9. The baby bottle holder of claim 1 wherein said plastic ring is flat on one side and has a smooth rounded berm all around the circumference of the bore on the other side.

10. The baby bottle holder of claim 9 wherein said plastic ring is made of a low density polyethylene.

11. The baby bottle holder of claim 10 wherein said strap is made of polypropelene.

12. The baby bottle holder of claim 11 wherein the hook and loop fastening strips are made of polypropelene.

13. The baby bottle holder of claim 12 wherein the strap is securely fastened to itself by stitching with a thread having a nylon-polyester blend.

14. The baby bottle holder of claim 13 wherein said plastic ring has embossed around its circumference on said other side, between the bore and the outside circumference, a series of common symbols.

15. The baby bottle holder of claim 13 wherein said plastic ring has embossed around its circumference on said other side, between the bore and the outside circumference, the alphabet.

16. The baby bottle holder of claim 13 wherein said plastic ring has embossed around its circumference on said other side, between the bore and the outside circumference, a series of arabic numbers.

* * * * *